US008061009B2

(12) United States Patent
Gory et al.

(10) Patent No.: US 8,061,009 B2
(45) Date of Patent: Nov. 22, 2011

(54) METHOD AND APPARATUS FOR CONNECTING SEVERAL CABLES WITH A COMPONENT AND A RIVET BUSHING THEREFORE

(75) Inventors: Philippe Gory, Saint Thibaud de Couz (FR); Hans-Joachim Dembowsky, Hamburg (DE); Johann-Haig Linden, Gütersloh (DE)

(73) Assignee: Bollhoff Verbindungstechnik GmbH (DE)

( * ) Notice: Subject to any disclaimer, the term of this patent is extended or adjusted under 35 U.S.C. 154(b) by 1208 days.

(21) Appl. No.: 11/800,874

(22) Filed: May 8, 2007

(65) Prior Publication Data

US 2007/0268654 A1 Nov. 22, 2007

(30) Foreign Application Priority Data

May 10, 2006 (DE) ..... 10 2006 021 844
Jul. 18, 2006 (DE) ..... 10 2006 033 279

(51) Int. Cl.
*B21J 15/02* (2006.01)

(52) U.S. Cl. ..... 29/525.06; 29/523

(58) Field of Classification Search ..... 29/505, 29/522.1, 523, 525.06; 411/43; 439/742
See application file for complete search history.

(56) References Cited

U.S. PATENT DOCUMENTS

| | | | | | |
|---|---|---|---|---|---|
| 1,403,813 | A | * | 1/1922 | Pinto | 411/368 |
| 1,874,507 | A | * | 8/1932 | Gribbie | 439/742 |
| 1,874,594 | A | | 8/1932 | Olson | |
| RE20,055 | E | * | 8/1936 | Huck | 72/370.01 |
| 2,324,142 | A | * | 7/1943 | Eklund | 411/38 |
| 2,767,877 | A | * | 10/1956 | Newsom | 403/167 |
| 2,954,064 | A | * | 9/1960 | De Mers | 29/561 |
| 3,835,615 | A | * | 9/1974 | King, Jr. | 403/408.1 |
| 3,835,688 | A | * | 9/1974 | King, Jr. | 72/370.07 |
| 3,949,535 | A | * | 4/1976 | King, Jr. | 403/388 |
| 4,405,256 | A | * | 9/1983 | King, Jr. | 403/408.1 |
| 5,599,210 | A | * | 2/1997 | Green | 439/763 |
| 6,077,009 | A | * | 6/2000 | Hazelman | 411/43 |
| 6,357,110 | B1 | | 3/2002 | Shipp et al. | |
| 6,670,555 | B2 | | 12/2003 | Ota et al. | |
| 6,960,723 | B2 | | 11/2005 | Fujii et al. | |

FOREIGN PATENT DOCUMENTS

| | | | |
|---|---|---|---|
| DE | 19845101 | | 4/2000 |
| DE | 10307270 | | 8/2003 |
| DE | 10338299 | | 4/2004 |
| FR | 2758910 | | 7/1998 |
| JP | 2000248657 | A * | 9/2000 |
| JP | 2002270328 | | 9/2002 |
| SU | 1650315 | A * | 5/1991 |

OTHER PUBLICATIONS

English Translation of p. 2 of German Search Report. German Patent No. DE 10 2006 033 279.2.

* cited by examiner

*Primary Examiner* — David Bryant
*Assistant Examiner* — Jacob Cigna
(74) *Attorney, Agent, or Firm* — Hiscock & Barclay, LLP

(57) ABSTRACT

In the case of the method of the invention, the cables of a cable harness are preassembled on a metallic rivet bushing by the cable harness manufacturer in that the cable shoes of the cables are pushed onto the rivet bushing and are prevented from loosening by a subsequently formed upset ridge. The rivet bushing with the attached cables is then delivered to the vehicle manufacturer, who pushes the rivet bushing onto a stud bolt provided on the body part. The rivet bushing with the cables held by it is then immobilized on the stud bolt by a nut. An apparatus for performing the procedure as well as a rivet bushing therefore are also described.

4 Claims, 4 Drawing Sheets

METHOD AND APPARATUS FOR CONNECTING SEVERAL CABLES WITH A COMPONENT AND A RIVET BUSHING THEREFORE

FIELD OF THE INVENTION

The present invention relates to a method and an apparatus for connecting several cables of a cable harness with a component, in particular a body part of a vehicle.

BACKGROUND OF THE INVENTION

For the attachment of a cable harness to a body part of a vehicle, a stud bolt is normally attached to the body part, onto which the cable shoes of the cables are pushed and then immobilized in a so-called plastic crown, which is arranged around the stud bolt. After all cable shoes are fitted on the stud bolts, they are immobilized in their position on the stud bolt by the screwing on of a nut.

This procedure, which is performed by the vehicle manufacturer, is comparatively complex and thus time- and cost-intensive. Moreover, it is relatively prone to problems since the certainty that all cables were installed depends on the reliability of the assembler.

The object of the present invention is to specify a method and an apparatus for connecting several cables of a cable harness with a component, in particular a body part of a vehicle, which are as easy and secure as possible. Furthermore, a rivet bushing should also be provided that is used in the procedure.

SUMMARY OF THE INVENTION

The method according to the invention comprises the following steps:

a) Producing a rivet bushing made of an electrically conductive material with a bushing section that is smaller in diameter and a bushing section that is larger in diameter, which together form a first arrangement or bearing surface, b) Pushing of eyelet-like cable shoes of the cables onto the bushing section of the rivet bushing with the smaller diameter, c) Deforming the bushing section of the rivet bushing with the smaller diameter for the formation of a second arrangement or bearing surface so that the cable shoes are held between the first and second arrangements of the rivet bushing, d) Pushing of the rivet bushing with the cable shoes held on it onto a stud bolt fastened on the component, and e) Immobilizing or affixing the rivet bushing with the cable shoes held on it onto the body part by screwing a nut onto the stud bolt.

In accordance with the method according to the invention, the cable shoes are thus preassembled on a rivet bushing. The installation of the cable shoes on the stud bolt of the body part is thereby simplified considerably. Moreover, the reliability of the procedure is increased since it is very easy to determine whether all cables are really connected thanks to the rivet bushing.

An especially important advantage of the invention is that the preassembly of the cables on the rivet bushing, i.e. the steps a) through c), can be performed by the cable harness manufacturer. The rivet bushing with the cables held on it can then be operated as one unit, which is delivered as such to a customer, for example a vehicle manufacturer. Then the vehicle manufacturer only needs to push the rivet bushing with the cables held on it onto the stud bolt and immobilize it thereon with a nut. This simplifies significantly the installation for the vehicle manufacturer.

The apparatus designed according to the invention for performing the procedure comprises in the simplest case a die plate, to which the one rivet bushing with its bushing section with the larger diameter can be attached, so that cable shoes can be pushed onto the bushing section with the smaller diameter, and an extrusion die, which is arranged on a common axis with the die plate and can be moved axially relative to the die plate, in order to deform the bushing section of the rivet bushing with the smaller diameter such that the cable shoes are held on the rivet bushing. The apparatus is very simple both in terms of its construction and functionality so that the preassembly of the cable shoes on the rivet bushing can be performed by the cable harness manufacturer in a simple and cost-effective manner.

The rivet bushing designed according to the invention consists of a bushing section with a smaller diameter and a bushing section with a larger diameter, which together form an arrangement. The arrangement is thus an extremely simple and cost-effective part.

Further advantageous embodiments of the invention are defined in the dependent claims.

BRIEF DESCRIPTION OF THE ACCOMPANYING DRAWINGS

Exemplary embodiments of the invention are described in greater detail based on the drawings.

DETAILED DESCRIPTION OF PREFERRED EMBODIMENTS OF THE INVENTION

A first embodiment of the method, the apparatus and the rivet bushing in accordance with the invention is described using FIGS. 1 through 9.

Figure 1:
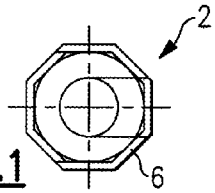
FIG. 1 shows a partially cut side view of a rivet bushing designed according to the invention.
Figure 2:
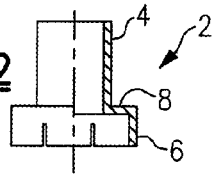
FIG. 2 shows a top view of the rivet bushing in FIG. 1.

The FIGS. 1 and 2 show a rivet bushing 2 with a bushing section 4 having a smaller diameter and a bushing section 6 having a larger diameter, which together form an arrangement 8 or bearing surface. In the exemplary embodiment shown, the arrangement 8 is made up of a shoulder, which runs perpendicular to the axis of the rivet bushing. The arrangement 8 could however also be a diagonally running shoulder or another diagonally running connection between the bushing sections 4 and 6. The bushing section 6 with a larger diameter has a noncircular shape, in the exemplary embodiment shown an octagonal cross-section, as emanates from FIG. 2.

The bushing section 4 of the rivet bushing 2 with the smaller cross-section and the bushing section 6 of the rivet bushing 2 with the larger diameter are both designed straight, i.e. without gradations, in the exemplary embodiment in FIGS. 1 and 2. The rivet bushing 2 is made of an electrically conductive, in particular metallic, material. Based on its simple shape and the material used, it is extremely easy to produce.

As was explained in the introduction to the description, the rivet bushing 2 serves to preassemble cable shoes 22 of several cables 21 of a cable harness. For this preassembly, an apparatus is provided, which is indicated schematically and fragmented in FIGS. 3 and 4.

Figure 3:
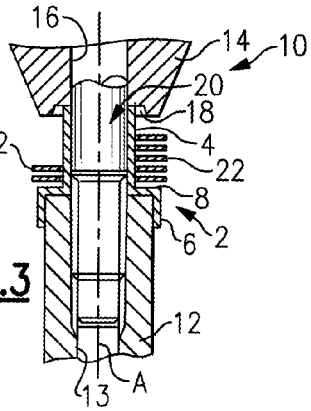
FIG. 3, 4 show longitudinal cuts through an apparatus for the preassembly of cable shoes on a rivet bushing before and after an upset process.
Figure 4:
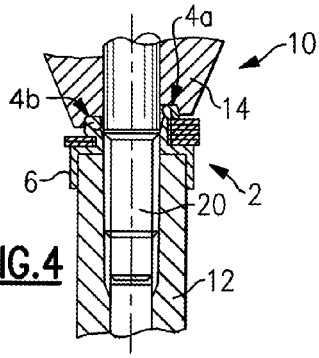

The apparatus 10 shown in FIGS. 3 and 4 is made of a die plate 12 with a longitudinally running bore hole 13, an extrusion die 14 with a longitudinally running bore hole 16 and a mandrel 20. All these components are arranged on a common axis A. The extrusion die 14 is to be run by a drive (not shown) that can be moved axially relative to the die plate 12 around pressing process. The mandrel 20 is movably mounted in the longitudinal bore hole 16 of the extrusion die 14 and can be inserted into the longitudinal bore hole 13 of the die plate 12.

For the preassembly of cables 21 on a rivet bushing 2, the rivet bushing 2 with its bushing section 6 with the larger diameter is first attached to the top side of the die plate 12. Then the eyelet-like cable shoes 22 of the cables 21 (also see FIG. 7) are pushed onto the bushing section 4 of the rivet bushing 2 with the smaller diameter. The length of the bushing section 4 with the smaller diameter is to be measured such that the number of pushable cable shoes 22 can be selected according to the respective application. For example, two cable shoes 22 are provided on the left side and five cable shoes 22 on the right side in FIG. 3.

Figure 5:
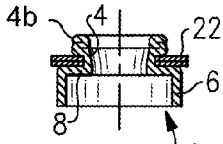
FIG. 5, 6 show axial cuts through a rivet bushing, on which two or five cable shoes are held by a folding bulge.
Figure 6:
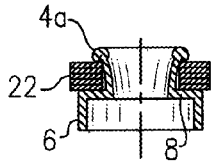

When the cable shoes 22 are pushed onto the bushing section 4 with the smaller diameter and are supported on the shoulder 8, the mandrel 20 is inserted through the rivet bushing 2 into the longitudinal bore hole 13 of the die plate 12. Then the extrusion die 14 is pushed axially downwards relative to the die plate 12, whereby an arrangement 4*a* or 4*b* is formed on the bushing section 4 with the smaller diameter, as can be seen in FIGS. 4 through 6.

In the exemplary embodiment shown, the arrangement 4*a* or 4*b* consists of an upset ridge. As shown, a more strongly folded upset ridge is created in the case of only two cable shoes, while a less strongly folded upset ridge is created in the case of five cable shoes. The formation of the upset ridge is promoted by a recess 18 on the bottom side of the extrusion die 14.

The arrangement 4*a* or 4*b* can be formed through an expansion process instead of through an upset process; the arrangement then consists of a simple inclined surface, which protrudes somewhat over the top side of the topmost cable shoe 22.

Figure 7:
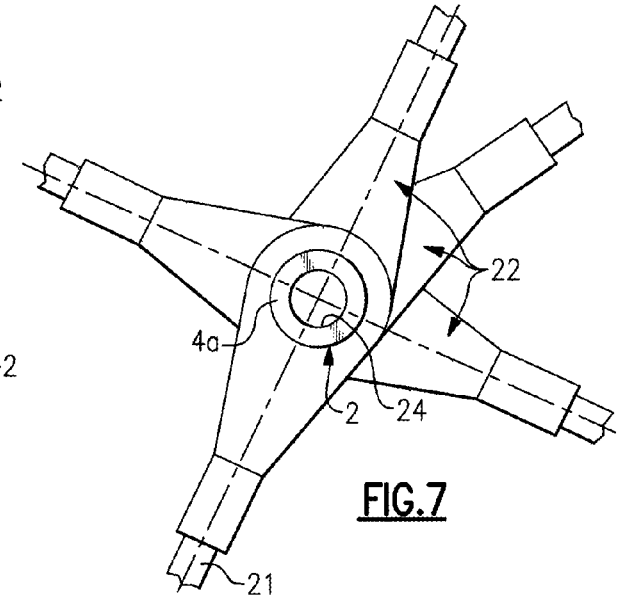
FIG. 7 is a top view of five cable shoes, which are immobilized on the rivet bushing by the folding bulge.

In the case of the exemplary embodiment shown, the cable shoes 22 are clamped free of play between the arrangement 4*a* or 4*b* and the arrangement 8 of the rivet bushing 2. The cable shoes 22 are thus not just held on the rivet bushing 2, but are also immobilized in their position relative to the rivet bushing 2 and relative to each other, as can be seen in FIG. 7.

Depending on the number of cable shoes 22 used, an upset ridge of the corresponding geometric configuration is created. In the exemplary embodiment shown, an only partially folded upset ridge 4*a* (right side of FIG. 4) is created when using five cables, while a fold bulge 4*b* folded one and a half times is created when using just two cables (left side in FIGS. 4 and 5).

The processes described up to this point are advantageously performed by the cable harness manufacturer. An inspection of the manufactured unit with respect to the number and position of the cable shoes as well as the functionality of the cables can also be performed there.

Figure 8:
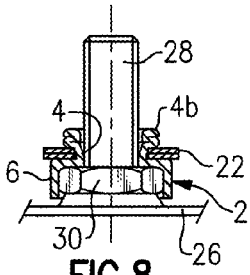
FIG. 8, 9 show sectional views corresponding with FIGS. 5 and 6, wherein however the rivet bushings with the cable shoes held on them are each pushed onto a stud bolt on a body part.
Figure 9:
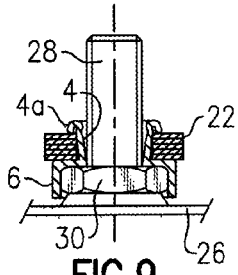

The unit consisting of the rivet bushing 2 and cables 21 attached to it is then delivered to the customer, for example the vehicle manufacturer. The vehicle manufacturer then pushes the rivet bushing 2 and the cable shoes 22 attached to it onto a stud bolt 28 fastened to a body part 26. As shown in FIGS. 8 and 9, the stud bolt 28 is provided with a base section 30, which has a multi-sided shape, which is adjusted for the shape of the bushing section 6 of the rivet bushing 2 with the larger diameter. When the rivet bushing with its bushing section 6 with the larger diameter is thus pushed onto the base section 30, the rivet bushing with the cable shoes 22 attached to it are secured against torsion relative to the stud bolt 28 and thus to the body part 26.

But other forms of a rotary protection between the rivet bushing 2 and the stud bolt 28 are also possible. For example, a form closure can be provided between the section with the smaller diameter 4 of the rivet bushing 2 and the shaft of the stud bolt 28. Instead of a form closure or in addition to a form closure, a material closure and/or a force closure could also be provided between the rivet bushing 2 and the stud bolt 28. The material closure could be made of an adhesive connection and the force closure of a press fit with or without roughening (knurling).

In order to also axially immobilize the rivet bushing 2 and the cable shoes 22, a nut (not shown) just needs to be screwed onto the stud bolt 28.

The assembly process is thus considerably simplified for the vehicle manufacturer, since it only needs to push the unit consisting of the rivet bushing and cable shoes onto the stud bolt and secure it there using a nut.

A second embodiment of the method, the apparatus and the rivet bushing in accordance with the invention is described using FIGS. 10 through 19. The components according to the previous embodiment are described with the same reference numbers, increased by 100. Since the second embodiment is largely corresponds with the first embodiment, the following description is restricted to the differences between the two embodiments.

Figure 10:
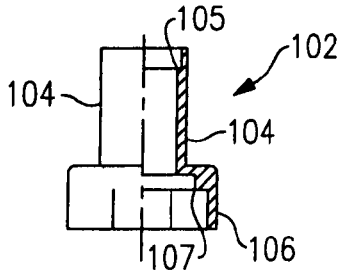
FIG. 10, 11 show representations according to FIGS. 1 and 2 of a modified embodiment of the rivet bushing.
Figure 11:
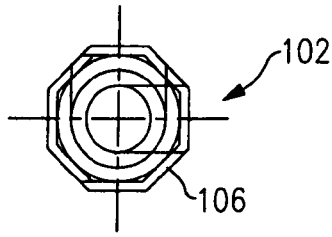

As can be seen in FIGS. 10 and 11, the rivet bushing 102 primarily corresponds with that in FIGS. 1 and 2. The only difference is that the bushing section 104 with the smaller diameter and the bushing section 106 with the larger diameter are both provided with a gradation 105 or 107 in their bore hole, the purpose of which is described below in connection with FIGS. 12 and 13.

Figure 12:
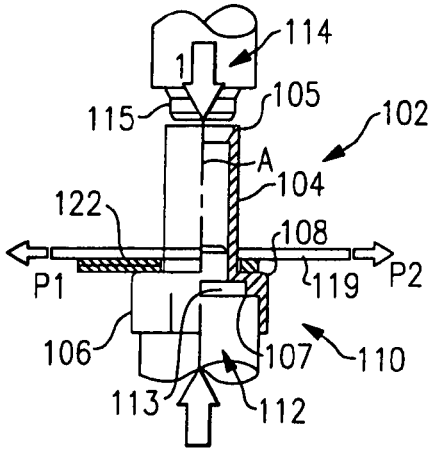
FIG. 12, 13 show representations according to FIG. 3 of an apparatus for the preassembly of two or seven cable shoes on the rivet bushing of FIGS. 10, 11.
Figure 13:
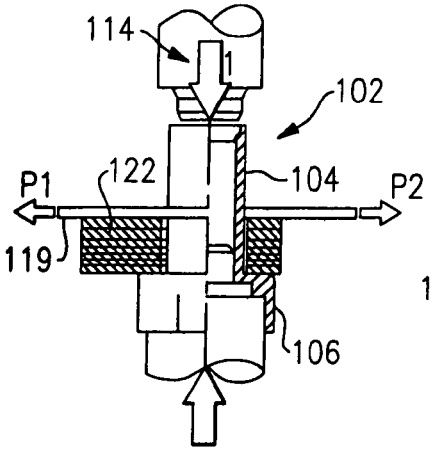
Figure 18:
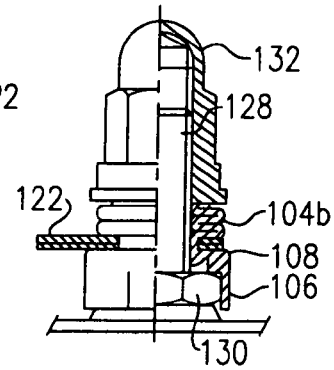
FIG. 18, 19 show views corresponding with FIGS. 16, 17 after the immobilization of the cable shoes and the rivet bushing on the body part by a nut, FIG. 20, 21 show representations according to FIGS. 3 and 13 of an apparatus with a hold-down device for exerting a hold-down force.
Figure 19:
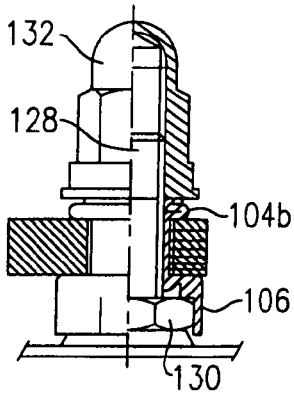

The apparatus for the preassembly of the rivet bushing 102 according to FIGS. 12 and 13 consists in turn of a die plate 112 and an extrusion die 114. However, the difference from the embodiment in FIGS. 3, 4 is that there is no mandrel. Rather, the die plate 112 and the extrusion die 114 are made of a solid material and are provided on their facing ends with an appendage 113 or 115 with a decreased diameter. The appendages 113 and 115 work together with the gradations 107 or 105 during the upset formation of the rivet bushing 102 in order to ensure a proper fold bulge formation.

Another difference between the embodiments in FIGS. 12, 13 and those in FIGS. 3, 4 is that a spacer 119 is provided in the embodiment in FIGS. 12, 13. The spacer 119 is disk-like and is made of two or more parts, which are arranged between the cable shoes 122 and the thereby created arrangement 104*a* or 104*b* (upset ridge) during the upset deformation of the rivet bushing 102. After formation of the upset ridge, the parts of the spacer 119 are removed laterally, as indicated by arrows P1, P2.

Figure 14:
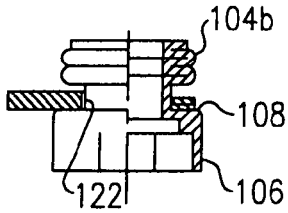
FIG. 14, 15 show partially cut side views of the rivet bushing with two or seven cable shoes after the preassembly with the help of the apparatuses in FIGS. 12, 13.
Figure 15:
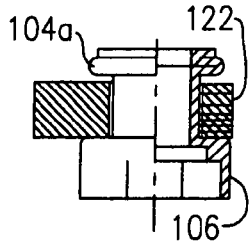
Figure 16:
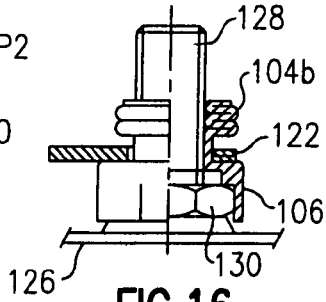
FIG. 16, 17 show representations according to FIGS. 14, 15, wherein however the rivet bushings with the cable shoes held on them are each pushed onto a stud bolt on the body part.
Figure 17:
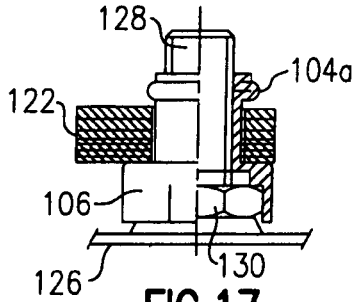

The cable shoes 122 are then held with axial play between the arrangement 104*a* or 104*b* and the arrangement 108 of the rivet bushing, as can be seen in FIGS. 14 and 15. The cable shoes 122 are thus not yet immobilized in their position with respect to the rivet bushing 102. This makes it possible to immobilize the position of the cable shoes relative to the rivet bushing 102 and relative to the body part 126 during final assembly of the rivet bushing and the cable shoes on the stud bolt 128. For this purpose, during final assembly, a nut 132 is screwed with the stud bolt 128 such that the arrangement 104*a* or 104*b* is deformed and thereby pressed against the cable shoes 122. The cable shoes 122 are then firmly clamped between the arrangement 108 and the arrangement 104*a* or 104*b* whereby they are immobilized in their position relative to the rivet bushing 102 and the body part 126.

As an example, two and seven cable shoes 122 to be connected are shown in the embodiment in FIGS. 10 through 19. However, it is understood that a different number of cable shoes can be selected depending on the application.

Figure 20:
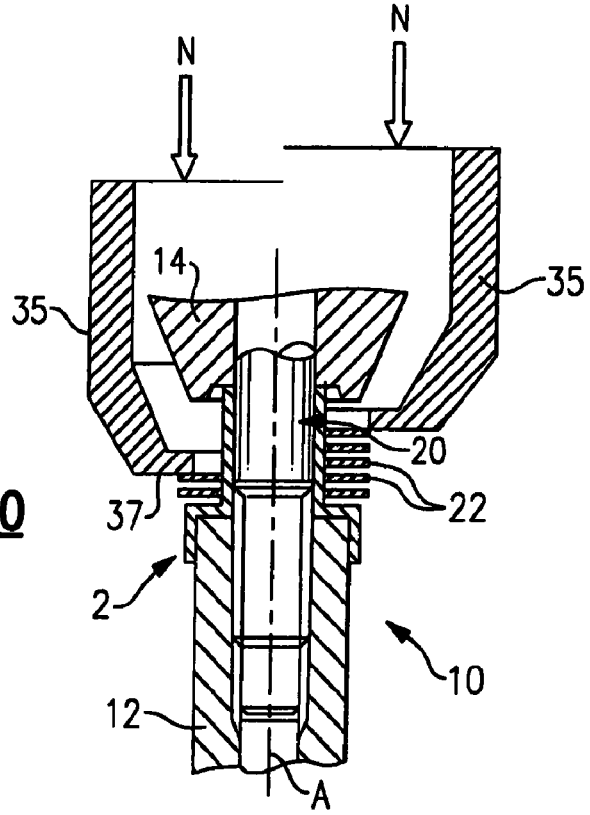
Figure 21:
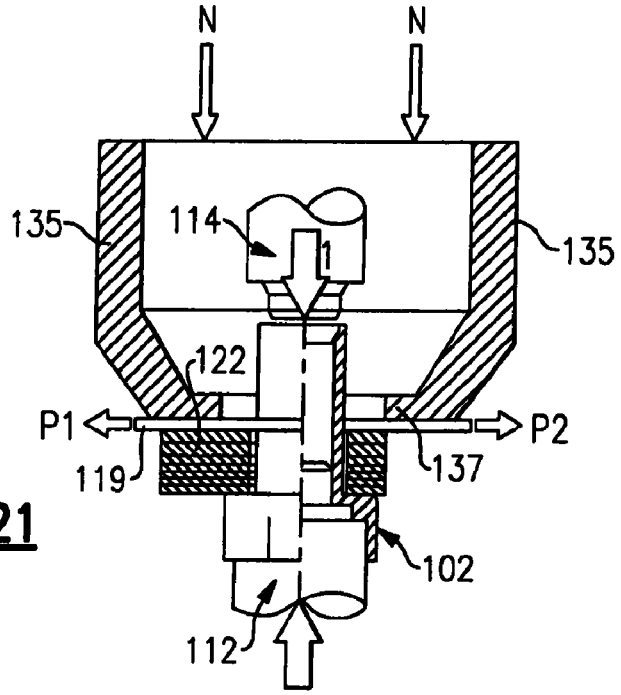

The apparatuses shown in FIGS. 20 and 21 correspond with the apparatuses in FIGS. 3, 4 or 12, 13, which were however modified such that they are each provided with a hold-down device 35 or 135. As indicated by arrows N, the respective hold-down device 35 or 135 exerts a hold-down force on the cable shoes 22 or 122 supported on the rivet bushing 2 or 102.

As shown, the hold-down device 35 or 135 has the shape of a sleeve, which surrounds the extrusion die 14 or 114 and is provided with a radially inwards projecting flange 37 or 137 on its bottom end. The flange 37 engages with the top side of the cable shoes, while the flange 137 can exert the hold-down force on the cable shoes 122 via the spacer 119.

The hold-down device 35 or 135 is designed and controlled such that it exerts the hold-down force on the cable shoes before and/or during and/or after the deformation of the rivet bushing 2 or 102. This allows the realization of an optimal connection of the cable shoes with the rivet bushing.

Figure 22:
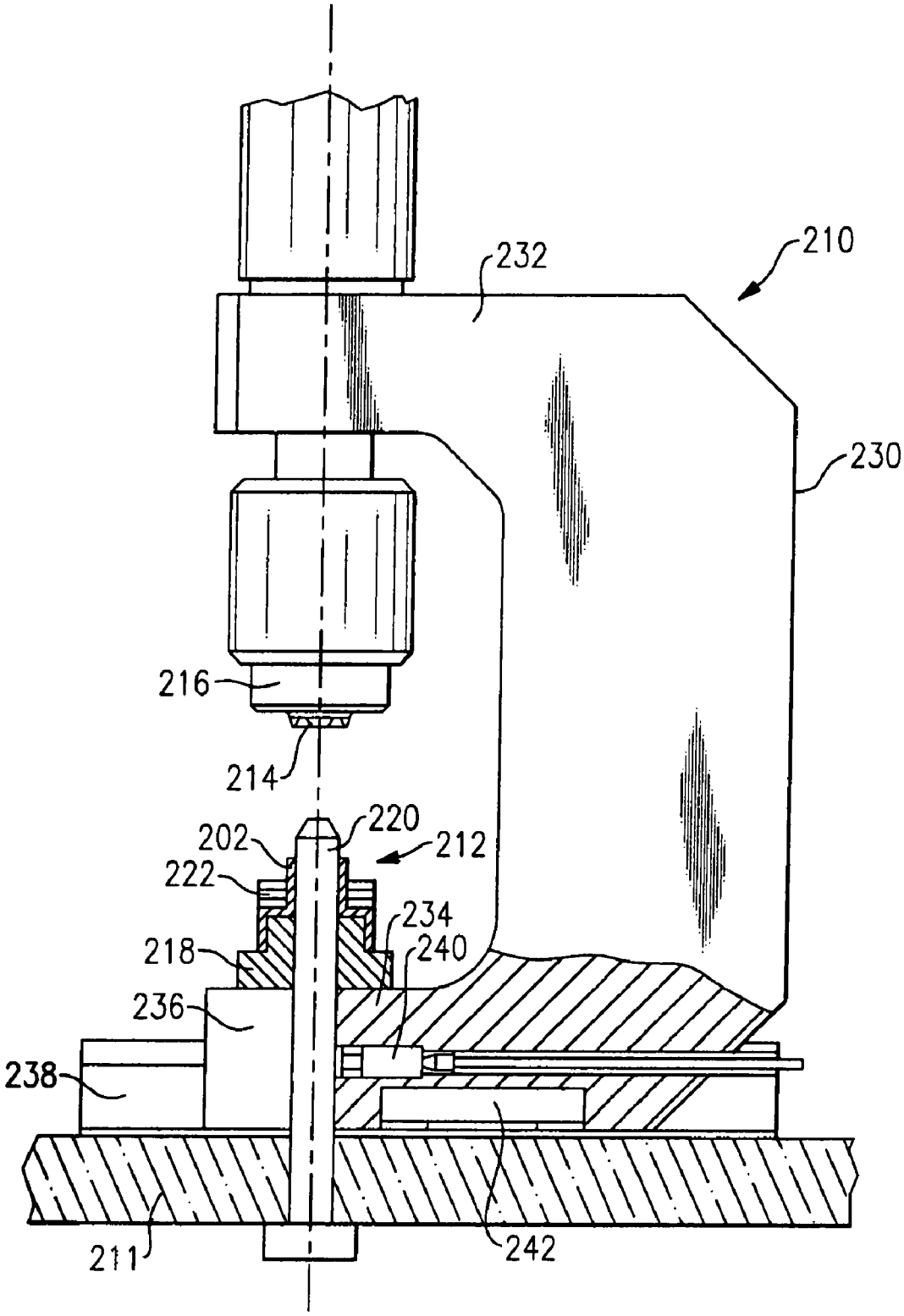
FIG. 22 shows a modified embodiment of an apparatus for the preassembly of cable shoes on a rivet bushing.

FIG. 22 shows a modified exemplary embodiment of an apparatus 210 for the preassembly of cable shoes 222 on a rivet bushing 202. In the case of the apparatus 210, the die plate 212 accepting the rivet bushing 202 and the cable shoes 222 consists of a ring body 218 and a mandrel 220, on which the ring body 218 is arranged in an axially movable manner. The mandrel 220 is permanently connected with a plate-like base 211 on its bottom end and is—in FIG. 22—arranged to run vertically such that the rivet bushing 202 can be pushed onto the ring body 218 over the free upper end of the mandrel 220. The top end of the mandrel 220 then protrudes axially over the rivet bushing 202.

In the apparatus 210 in FIG. 222, the extrusion die 214 forms part of a setting head 216, which is attached to the top leg 232 of a C frame 230. The bottom leg of the C frame 230 forms a counter holder 236, which is arranged between the ring body 218 of the die plate 212 and the base 211 in the state shown in FIG. 22.

The extrusion die is moved axially downwards for the preassembly of the cable shoes 22 on the rivet bushing 202, in which the rivet bushing 202 is provided with an upset ridge through a pressing process. The free end of the mandrel 220 thereby enters into an axial bore hole (not shown) of the extrusion die, whereupon the extrusion die then deforms the upper end of the rivet bushing 202 in order to form the upset ridge. The deformation force thereby exerted on the rivet bushing is then transferred to the base 211 via the ring body 218 and the counter holder 234 designed separately.

As emanates from FIG. 22 and the previous description of the apparatus 210, the C frame 230 with the setting head 216 and the counter holder 234 is designed separately from the other part of the apparatus 210, in particular separately from the die plate 212 and the base 211. In order to separate the C frame 230 from the other part of the apparatus 210 and in order to be able to reconnect it, the counter holder 234 is provided with an axially penetrating slit 236 with a U-shaped cross-section, which can accept the mandrel. Due to the slit 236, the counter holder 234 and thus the entire C frame 230 can be moved laterally relative to the mandrel 220, and namely between the operating position shown in FIG. 22, in which the counter holder 234 is arranged between the ring body 218 and the base 211, and a non-operating position, in which the entire C frame 230 and thus the counter holder 234 are released from the die plate 212 and the base 211. Since the ring body 218 is arranged on the mandrel 220 in a slidable manner, the ring body 218 can slide on the mandrel 220 downwards in contact with the base 211 if the C frame 230 was removed in the lateral direction from the mandrel 220.

In order to ensure that the mandrel 220 and the extrusion die 214 lie on a common axis in the operating position despite the separate formation of the C frame 230 from the other part of the apparatus 210, a guide 238 (indicated schematically) is provided, which guides the counter holder 234 in its operation position such that the mandrel 220 aligns with the extrusion die 214. Furthermore, the C frame 230 is provided with a sensor device 240, which captures the position of the mandrel 220 relative to the counter holder 234. The sensor device 240 is designed such that it only allows actuation of the extrusion die 214 when the counter holder 234 and thus the extrusion die 214 assume their correct position relative to the die plate 212, in order to ensure the proper functioning of the apparatus 210. Instead of or in addition to the sensor device 240, a locking device (not shown) can be provided, which ensures that the extrusion die 214 can only be actuated when the components of the apparatus 210, in particular the extrusion die 214 and the mandrel 220, assume their correct position, in which the proper functioning of the apparatus 210 is ensured.

Furthermore, FIG. 22 schematically indicates a lifting device 242, which is in the position to at least slightly lift the C frame 230 and thus the counter holder 234 relative to the base 211 and thus relative to the mandrel 220. This makes it possible to release the rivet bushing 202 firmly clamped on the mandrel 220 after the pressing process so that it can then be removed without incident from the mandrel 220 together with the cable shoes 222. The only schematically indicated lifting device 242 can be designed in any manner and can be actuated e.g. mechanically, pneumatically, hydraulically or electrically.

We claim:

1. Method for connecting several cables of a cable harness with a component, in particular a body part of a vehicle, which has the following steps:

a) producing a rivet bushing made of an electrically conductive material with a bushing section smaller in diameter and a bushing section larger in diameter, which together form a first arrangement, b) pushing of eyelet-like cable shoes of the cables onto the bushing section of the rivet bushing with the smaller diameter, wherein a spacer made of at least two parts is arranged on the rivet bushing section with the smaller diameter, c) deforming by an upset process the bushing section of the rivet bushing with the smaller diameter for the formation of a second arrangement, wherein said spacer is arranged between said cable shows and said second arrangement, and thereafter removing laterally the parts of the spacer so that the cable shoes are arranged with play between the first and second arrangement of the rivet bushing, d) pushing of the rivet bushing with the cable shoes held on it onto a stud bolt fastened on the component, and e) clamping the cable shoes between the first and second arrangement of the rivet bushing and thereby immobilizing them in their position relative to the rivet bushing and immobilizing the rivet bushing with the cable shoes held on it on the component by screwing a nut onto the stud bolt.

2. Method according to claim 1, in which in the case of step a) the first arrangement is designed as a vertically or diagonally running shoulder between the bushing section of the rivet bushing with the smaller or larger diameter.

3. Method according to claim 1, characterized in that in step d) a rotary protection is formed between the cable shoes and the stud bolt.

4. Method according to claim 1, characterized in that the steps a) through c) are performed by at least one manufacturer, in that the rivet bushing with the cables held on it is transported to a customer of a manufacturer and in that the steps d) and e) are performed by the customer.

* * * * *